United States Patent [19]

Coffey

[11] 4,383,371

[45] May 17, 1983

[54] SCOPE MOUNT FOR HANDGUN

[76] Inventor: Fred W. Coffey, 4433 Crawford #6, Abilene, Tex. 79605

[21] Appl. No.: 344,003

[22] Filed: Jan. 29, 1982

[51] Int. Cl.[3] ..... F41G 3/00

[52] U.S. Cl. ..... 33/245; 33/247; 33/250; 42/1 ST

[58] Field of Search ..... 33/245, 246, 247, 250, 33/252; 42/1 ST

[56] References Cited

U.S. PATENT DOCUMENTS

| | | | |
|---|---|---|---|
| 2,193,094 | 3/1940 | Gilbert | 33/245 |
| 2,451,266 | 10/1948 | Whittemore | 33/245 |
| 2,464,134 | 3/1949 | Hugg | 33/245 |
| 3,405,448 | 10/1968 | Weatherby | 33/245 |
| 3,555,687 | 1/1971 | Joseph | 33/245 |
| 3,750,318 | 8/1973 | Burris | 33/250 |

OTHER PUBLICATIONS

"Scope Your Way to Handgun Accuracy", The American Rifleman, vol. 120, No. 1, p. 35-Jan. 1972.

*Primary Examiner*—Willis Little
*Attorney, Agent, or Firm*—Harvey B. Jacobson

[57] ABSTRACT

An elongated body is provided and extends along the upper rear frame portion of a revolver above the cartridge cylinder thereof swingable outwardly of one side of the frame portion. A first side of the body extends along the aforementioned one side of the frame portion and a second side of the body extends along the other side of the frame portion and includes a depending flange extending therealong and terminating downwardly in a first inwardly directed lip engaged under the other side of the frame portion. The first side of the body includes a depending retainer member extending therealong and having a second inwardly directed lip engaged beneath the one side of the frame portion. The second lip is bevelled for camming engagement beneath the frame portion one side and the upper portion of the retainer member and the first side of the body include coacting projection and recess portions extending therealong and loosely engaged with each other supporting the retainer member from the first side of the body for lateral shifting relative thereto and limited relative up and down movement. First threaded fastener structure is connected between the body and the retainer member adjustably drawing the latter laterally of the body toward the depending flange thereof and second fastener structure is connected between the body and the retainer member for adjustably drawing the retainer member upwardly relative to the body.

8 Claims, 5 Drawing Figures

SCOPE MOUNT FOR HANDGUN

BACKGROUND OF THE INVENTION

Various forms of scope mounts heretofore have been provided for handguns including handguns of the revolver type. However, most of these scope mounts are constructed in a manner whereby at least some modifications must be made to the supporting handgun. Accordingly, a need exists for an improved form of scope mount for a revolver type of handgun and which may be utilized in conjunction with such a revolver type handgun independent of any modifications of the handgun itself.

Various forms of handgun and other firearm scope mounts including some of the general structural and operational features of the instant invention heretofore have been proided. Examples of these scope mounts are disclosed in U.S. Pat. Nos. 2,193,094, 3,405,448, 3,992,782 and 3,992,783.

U.S. Pat. No. 3,405,448 is the only patent of the above noted patents which is believed to be closely pertinent to the instant invention. This patent discloses generally equivalent structure although it is shown utilized in conjunction with a firearm barrel which has been prepared for the mounting of the scope mount thereon. In addition, U.S. Pat. No. 3,405,448 does not include structure whereby the horizontally adjustable retainer member or flange thereof is also vertically adjustable, this feature being very important to the instant application inasmuch as it allows the mount of the instant invention to be removably mounted upon a revolver without the mount interfering with the horizontal outward swinging movement of the cylinder of the revolver in order to reload the same.

BRIEF DESCRIPTION OF THE INVENTION

The scope mount of the instant invention has been specifically designed for use with a revolver and to allow a scope mount to be mounted on a revolver independent of any modifications being made to the revolver. Further, the scope mount is constructed in a manner whereby it may be adjusted, as required, in order to allow the mounting of the scope mount on a revolver in a manner which will not interfere with horizontal outward swinging movement of the cylinder of the revolver in order to reload the same.

In addition, the scope mount of the instant invention includes structure which allows the mount to be supported from an associated revolver with a simple clamping action and with the mount additionally including structure preventing shifting of the mount relative to the revolver frame as a result of recoil forces, even though the mount is only clamp engaged with the revolver frame.

The main object of this invention is to provide a scope mount for a revolver which may be mounted on many different types of revolvers independent of modifications to the revolvers upon which the scope is to be mounted.

Another object of this invention is to provide a scope mount in accordance with the preceding object and constructed in a manner whereby the scope mount may be revolver mounted in a manner such that outward swinging movement of the cylinder of the associated revolver will not be interfered with.

Still another object of this invention is to provide a scope mount which may be merely clamp engaged with the upper rear frame portion of a revolver and yet which will be prevented from shifting relative to the revolver as a result of recoil forces.

A final object of this invention to be specifically enumerated herein is to provide a scope mount for a revolver constructed in accordance with the preceding object and which will conform to conventional forms of manufacture, be of simple construction and easy to mount and use so as to provide a device that will be economically feasible, long lasting and relatively trouble free in operation.

These together with other objects and advantages which will become subsequently apparent reside in the details of construction and operation. as more fully hereinafter described and claimed, reference being had to the accompanying drawings forming a part hereof, wherein like numerals refer to like parts throughout.

DETAILED DESCRIPTION OF THE INVENTION

Figure 1:
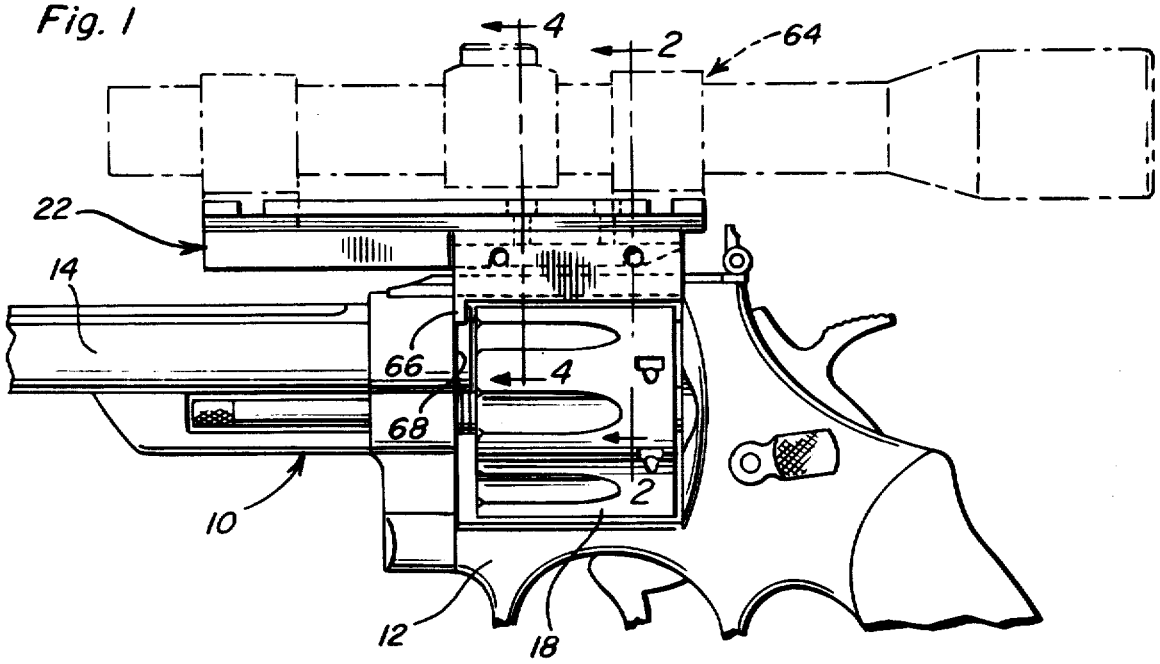
FIG. 1 is a fragmentary side elevational view of a typical form of revolver with the scope mount of the instant invention operatively mounted thereon and an attendant scope illustrated in phantom lines.

Referring now more specifically to the drawings the numeral 10 generally designates a conventional form of revolver including a main frame 12 and a forwardly projecting barrel 14. The frame 12 includes an upper rear front-to-rear extending frame portion 16 and a cylinder 18 is swingably supported from the frame 12 for outward swinging movement relative to the left side of the frame 12, as is conventional, in order to enable the bores 20 of the cylinder 18 to be reloaded.

Conventionally, the upper rear frame portion 16 is milled on opposite sides in the manner disclosed in U.S. Pat. Nos. 3,992,782 and 3,992,783 in order to provide a pair of opposite side grooves in which clamping components of a clamp assembly may be engaged for supporting a scope mount from the upper frame portion. However, the scope mount of the instant invention referred to in general by the reference numeral 22 is constructed in a manner whereby the milling of such slots in the upper frame portion is not required.

The scope mount 22 includes an elongated body 24 extending along and resting upon the upper frame portion 16. The body 24 includes right and left sides 26 and 28 which overlie the right and left sides of the frame portion 16 and the right side includes a depending flange 30 which terminates downwardly in an inwardly directed lip 32 engaged beneath the right side of the frame portion 16 between the latter and the underlying portion of the cylinder 18. The left side 28 of the body 24 defines a longitudinally extending and horizontally outwardly opening groove 34 and the left side of the body 24 includes an elongated retainer member 36 extending therealong including a horizontally outwardly directed tongue 38 loosely received in the groove 34. The retainer member 36 depends downwardly from the left side 28 of the body 24 and terminates downwardly in a second inturned lip 40 which is bevelled and slightly engaged beneath the left hand side of the frame portion 16.

The retainer member 36 includes upper transverse threaded bores 42 spaced therealong and the body 24 includes corresponding transverse smooth bores 44 spaced therealong equipped with counterbores 46. The bores 44 are slightly larger in diameter than the bores 42 and headed fasteners 48 are received in the bores 44 and the counterbores 46 and are threadedly engaged in the threaded bores 42. In addition, the upper portion 50 of the body 24 has a pair of vertical bores 52 formed therein and spaced longitudinally therealong and each of the bores 52 is equipped with a counterbore 54. The bores 52 are registered with threaded vertical bores 56 formed in the tongue 38 of the retainer member 36. The fasteners 48 may be utilized to draw the retainer member 36 toward the flange 30 and headed fasteners 58 are received in the bores 52 and the counterbores 54 and are threadedly engaged in the bores 56 to draw the tongue 38 upwardly in the groove 34 in which the tongue 38 is loosely received. Accordingly, with the upper frame portion 16 abutted against the undersurface 60 (see FIG. 4) of the body 24 between the flange 30 and the retainer member 36 the fasteners 48 may be initially tightened to engage the lip 40 beneath the left hand side of the frame member 16 and the fasteners 58 may then be tightened in order to draw the tongue 38 upwardly in the groove 34 so as to position the undersurface 62 of the retainer member 36 as high as possible and thus provide sufficient clearance for lateral outward swinging movement of the cylinder 18. Of course, the mount 22 has its upper portion 50 formed in a manner such that a telescopic sight such as that generally designated by the reference numeral 64 may be readily supported therefrom.

Figure 4:
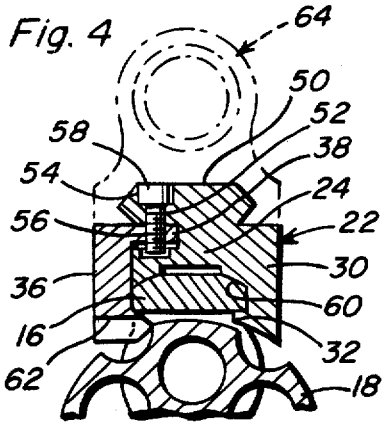
FIG. 4 is a fragmentary enlarged vertical sectional view taken substantially upon the plane indicated by the section line 4—4 of FIG. 1.
Figure 5:
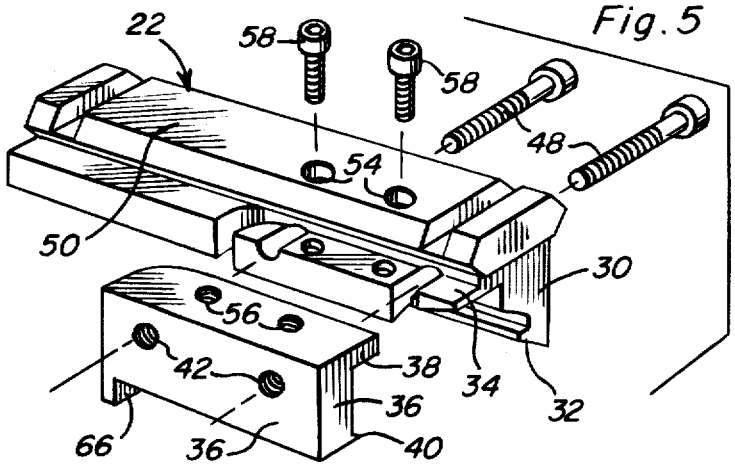
FIG. 5 is an exploded perspective view of the scope mount.

With attention now invited more specifially to FIGS. 4 and 5 of the drawings, it may be seen that the forward end of the retainer member 36 includes a depending and inwardly projecting tang 66. The tang 66 is received behind the rearwardly facing surface 68 of the frame 12 which defines the forward upper portion of the opening of the frame 12 in which the cylinder 18 is received. Thus, the tang 66 will not allow recoil forces acting upon the revolver 12 to cause forward shifting of the mount 22 on the frame portion 16, even though the mount 30 is only clamp engaged with the frame portion 16.

Figure 2:
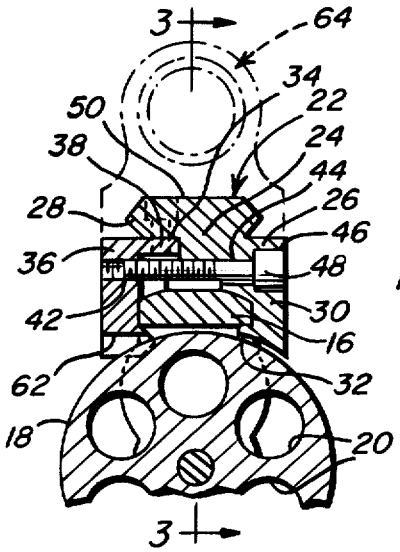
FIG. 2 is a fragmentary enlarged vertical sectional view taken substantially upon the plane indicated by the section line 2—2 of FIG. 1 and on somewhat of an enlarged scale.
Figure 3:
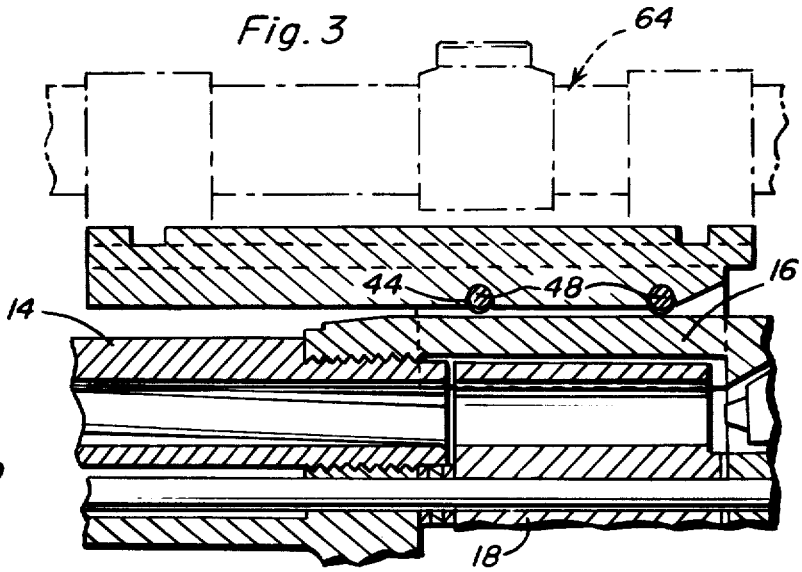
FIG. 3 is an enlarged vertical sectional view taken substantially upon the plane indicated by the section line 3—3 of FIG. 2.

In operation, when it is desired to initially position the body 24 of the mount 22 on the frame portion 16, the retainer member 36 is removed and the body 24 is "rolled" onto the frame portion 16 from the right side thereof as a result of slight angular displacement of the body 24 in a counterclockwise direction as viewed in FIGS. 2 and 3 of the drawings. Thereafter, the retainer member 36 has its tongue 38 engaged in the groove 34 and the fasteners 48 are initially tightened. Then, the fasteners 58 are installed and tightened sufficiently to raise the retainer member 36 upwardly above the uppermost path of outward swinging movement of the cylinder 18. Thereafter, the fasteners 48 and 58 may be further tightened. It is to be noted that the mount 22 may be removed from or mounted upon the revolver 10 independent of removal of the rear sight thereof.

With the mount 22 thus mounted, the mount 22 enjoys a firm clamped engagement with the upper frame portion 16 and the tang 66 prevents shifting of the mount 22 relative to the frame 12 as a result of recoil forces.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a handgun of the revolver type including an elongated upper front-to-rear extending rear frame portion beneath which a cartridge cylinder is closely mounted for rotation about a front-to-rear extending axis and for swinging laterally outwardly to one side of said frame portion and with said handgun further including a rearwardly facing surface portion spaced below said upper rear frame portion and spaced slightly forward of said cylinder; a scope mount including an elongated body disposed over and extending along said upper rear frame portion and defining first and second longitudinal sides extending along said one side and the other side, respectively, of said upper rear frame portion, said second side including a depending flange extending therealong and terminating downwardly in a first inwardly directed lip engaged under said other side, said first side of said body including a depending retainer member extending therealong and having a lower second inwardly directed lip engaged beneath said one side of said upper rear frame portion, said second lip being bevelled for camming engagement beneath said one side, the upper portion of said retainer member and said first side of said body including coacting projection and recess portions loosely engaged with each other supporting said retainer member from said first side of said body for lateral shifting relative thereto and limited relative up and down movement, first threaded fastener means connected between said body and retainer member adjustably drawing the latter laterally of said body toward said depending flange and second fastener means connected between said body and retainer member adjustably drawing said retainer member upwardly relative to said body.

2. The mount of claim 1 wherein said fastener means comprise threaded bolts received through smooth bores formed in said body and threadedly engaged in threaded bores formed in said retainer member, the bores in which said bolts comprising said first retainer means are received being horizontally disposed and extending transversely of said body and the bores in which the bolts defining said second fastener means are received being vertically disposed.

3. The mount of claim 1 wherein the upper central portion of said body includes means for supporting a scope therefrom.

4. The mount of claim 1 wherein said depending retainer member includes an inwardly directed tang supported therefrom and projecting toward said flange and receivable behind said rearwardly facing surface forward of said cylinder.

5. The mount of claim 1 wherein said coacting projection and recess portions comprise a horizontally outwardly opening groove formed in said first side of said body and a horizontally outwardly projecting flange carried by said retainer member projecting toward said second side of said body and loosely slidingly and vertically shiftably received in said groove.

6. The mount of claim 5 wherein said fastener means comprise threaded bolts received through smooth bores formed in said body and threadedly engaged in threaded bores formed in said retainer member, the bores in which said bolts comprising said first retainer means are received being horizontally disposed and extending transversely of said body and the bores in which the bolts defining said second fastener means are received being vertically disposed.

7. The mount of claim 6 wherein the upper central portion of said body includes means for supporting a scope therefrom.

8. The mount of claim 7 wherein said depending retainer member includes an inwardly directed tang supported therefrom projecting toward said flange and receivable behind said rearwardly facing surface forward of said cylinder.

* * * * *